US006645257B1

(12) United States Patent
Schacht et al.

(10) Patent No.: US 6,645,257 B1
(45) Date of Patent: Nov. 11, 2003

(54) PROCESS FOR PIGMENTING WOOD

(75) Inventors: Hans-Thomas Schacht, Rheinfelden (DE); Gilbert Moegle, Magstatt-le-Bas (FR); Reiner Jahn, Müllheim (DE); Christiane Griessen, Basel (CH); Peter Scheibli, Binningen (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 137 days.

(21) Appl. No.: 09/663,833

(22) Filed: Sep. 15, 2000

(30) Foreign Application Priority Data

Oct. 6, 1999 (CH) ..... 1823/99

(51) Int. Cl.[7] ..... D06P 3/60

(52) U.S. Cl. ..... 8/402; 8/620; 8/636; 8/637.1; 8/647

(58) Field of Search ..... 8/402, 620, 636, 8/637.1, 647

(56) References Cited

U.S. PATENT DOCUMENTS

| | | | | | |
|---|---|---|---|---|---|
| 4,752,297 | A | | 6/1988 | Leach | 8/402 |
| 4,792,357 | A | | 12/1988 | Bier | 106/83 |
| 5,171,328 | A | * | 12/1992 | Trauth et al. | 8/402 |
| 5,746,778 | A | * | 5/1998 | Jankewitz et al. | 8/402 |

FOREIGN PATENT DOCUMENTS

| | | | | |
|---|---|---|---|---|
| JP | 61/41503 | | 2/1986 | |
| WO | WO 98/32802 | * | 7/1998 | C09B/69/08 |
| WO | WO 98/58027 | * | 12/1998 | C09C/3/08 |
| WO | 98/580027 | | 12/1998 | |
| WO | 00/36210 | | 6/2000 | |

OTHER PUBLICATIONS

Chem. Abst. 1986:445090, DN 105:45090 Aug. 1984.
Derw. Abst. 79–74577B [41] of JP 54113403 2/86.

* cited by examiner

*Primary Examiner*—Yogendra N. Gupta
*Assistant Examiner*—Eisa Elhilo
(74) *Attorney, Agent, or Firm*—Kevin T. Mansfield

(57) ABSTRACT

A process for pigmenting wood, which comprises treating wood in succession:

a) with a solution comprising from 0.01 to 80% by weight, based on the solution, of a compound of the formula $$A(B)_x \qquad (I),$$

in which x is an integer from 1 to 8,

A is the radical of a chromophore of the quinacridone, anthraquinone, perylene, indigo, quinophthalone, indanthrone, isoindolinone, isoindoline, dioxazine, azo, phthalocyanine or diketopyrrolopyrrole series which is attached to x groups B via one or more heteroatoms, these heteroatoms being selected from the group consisting of N, O and S and forming part of the radical A, B is hydrogen or a group of the formula at least one group B not being hydrogen and, if x is a number from 2 to 8, the groups B being identical or different, and L is any desired group suitable for solubilization; and from 0.05 to 5% by weight, based on the solution, of a salt of the formula $$Kat^+.An^- \qquad (II),$$

$$Kat^+.\tfrac{1}{2}An^{2-} \qquad (III)$$

or $$Kat^+.\tfrac{1}{3}An^{3-} \qquad (IV),$$

in which $Kat^+$ is lithium, sodium, potassium or ammonium, $An^-$ is formate, acetate, propionate or hydrogen carbonate, $An^{2-}$ is oxalate, maleate, fumarate, malonate, carbonate or hydrogen phosphate, and $An^{3-}$ is citrate or phosphate, in water or an organic solvent or in a single-phase mixture thereof, b) with a solution comprising from 0.01 to 50% by weight, based on the solution, of an organic $C_1$–$C_6$carboxylic acid in water or an organic solvent or in a single-phase mixture thereof, and c) converting the compound of the formula (I) thermally to a pigment of the formula $A(H)_x$ (V).

8 Claims, No Drawings

PROCESS FOR PIGMENTING WOOD

The background of the invention is constituted by composite wood materials which are to be processed only after colouring. Thin sheets of wood, coloured right through, are bonded together, shaped and then cut at a wide variety of angles to produce artistic effects which depend on the grain. These materials may be used in particular to produce design articles or for decorative purposes. The requirements in terms of light stability and right-through coloration are therefore significantly higher than in the case of customary wood veneers. In particular, it is essential for the individual sheets of wood to be coloured right through with a high degree of homogeneity, even in the case of relatively great thicknesses, since the core of the sheets becomes visible as a result of the artistic cutting.

JP-A-54/113403 discloses a process for the homogeneous colouring of wood veneers, in which the wood is first treated under hot conditions with an alkali, including sodium acetate and sodium bicarbonate, at a pH of 10 and only then is coloured with an appropriate dye, for example with C.I. Acid Blue 171.

JP-A-61/41503 discloses a process for the homogeneous colouring of wood veneers with an anionic direct dye, the optimum being achieved using a moderately soluble salt, including sodium bicarbonate, in saturated concentration.

However, these dyes do not have sufficiently satisfactory fastness properties for the abovementioned applications, especially when used outdoors or when exposed to sunlight, for example as wall boards in a glazed corridor.

WO-98/58027 discloses the colouring of porous materials, including wood, starting from soluble pigment precursors. However, the pigmentation is greater at the surface than in the interior of the material. It has been found, moreover, that the presence of an acid is necessary as a catalyst for regenerating the majority of pigments, to ensure that the pigment is not damaged by overheating to 160° C. or more.

It has now surprisingly been found that pigmentation of wood materials with significantly better penetration is obtained if wood is treated in succession with soluble pigment precursors from WO-98/58027 in the presence of a small amount of a weakly basic salt and subsequently with an organic acid, and only then is the pigment thermally regenerated.

The invention therefore relates to a process for pigmenting wood, which comprises treating wood in succession a) with a solution comprising from 0.01 to 80% by weight, based on the solution, of a compound of the formula $$A(B)_x \quad \text{(I)},$$

in which x is an integer from 1 to 8,

A is the radical of a chromophore of the quinacridone, anthraquinone, perylene, indigo, quinophthalone, indanthrone, isoindolinone, isoindoline, dioxazine, azo, phthalocyanine or diketopyrrolopyrrole series which is attached to x groups B via one or more heteroatoms, these heteroatoms being selected from the group consisting of N, O and S and forming part of the radical A, B is hydrogen or a group of the formula

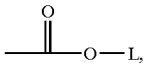

at least one group B not being hydrogen and, if x is a number from 2 to 8, the groups B being identical or different, and L is any desired group suitable for solubilization; and from 0.05 to 5% by weight, based on the solution, of a salt of the formula $$Kat^+.An^- \quad \text{(II)},$$

$$Kat^+.\tfrac{1}{2}An^{2-} \quad \text{(III)}$$

or $$Kat^+.\tfrac{1}{3}An^{3-} \quad \text{(IV)},$$

in which $Kat^+$ is lithium, sodium, potassium or ammonium, $An^-$ is formate, acetate, propionate or hydrogen carbonate, $An^{2-}$ is oxalate, maleate, fumarate, malonate, carbonate or hydrogen phosphate, and $An^{3-}$ is citrate or phosphate, in water or an organic solvent or in a single-phase mixture thereof, b) with a solution comprising from 0.01 to 50% by weight, based on the solution, of an organic $C_1$–$C_6$carboxylic acid in water or an organic solvent or in a single-phase mixture thereof, and c) converting the compound of the formula (I) thermally to a pigment of the formula $A(H)_x$ (V).

The wood in question may be any desired hardwood or softwood, such as obeche, ash, birch, poplar, fir, spruce, pine, tulip tree, maple, bird's-eye maple, sycamore maple, oak, beech, mahogany, myrtle, anigre, tay (koto), mappa, elm, zebrano, carbalho, vavona or ogea, for example.

A is the radical of known chromophores having the basic structure $A(H)_x$ (VI), A preferably having at least one directly adjacent or conjugated carbonyl group on each heteroatom attached to x groups B, such as

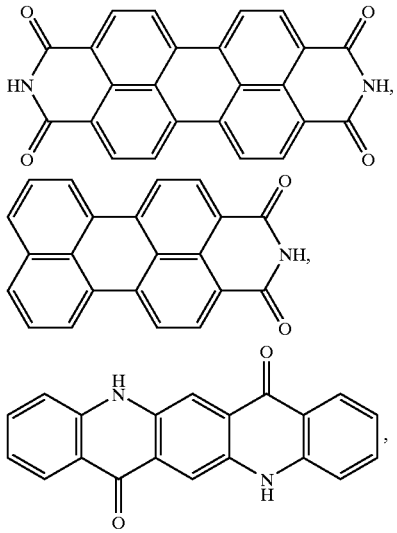

-continued
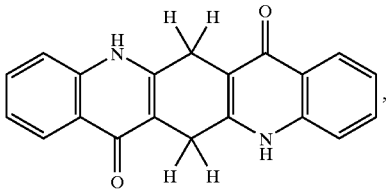
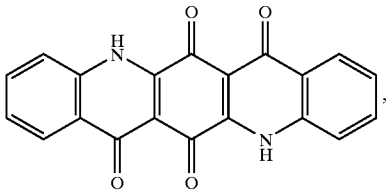
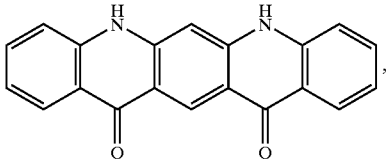
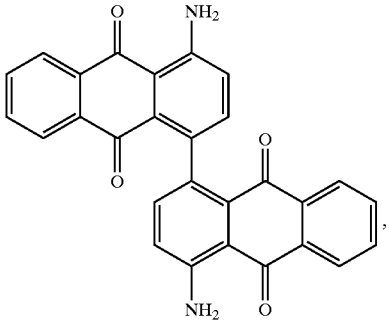
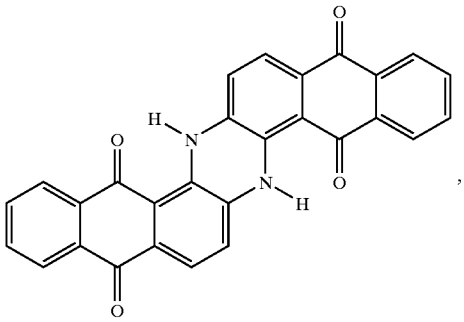
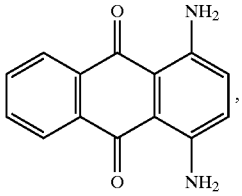
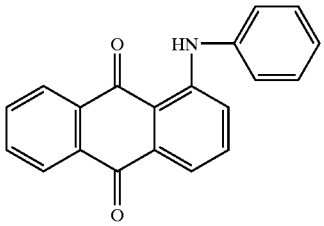
-continued
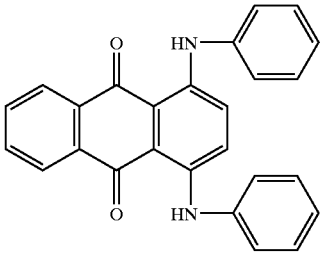
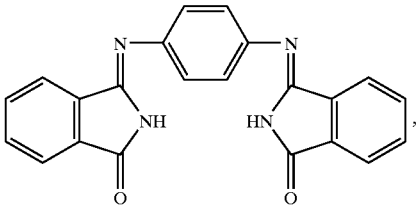
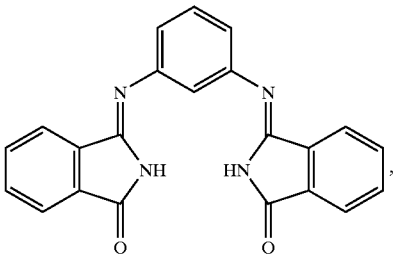
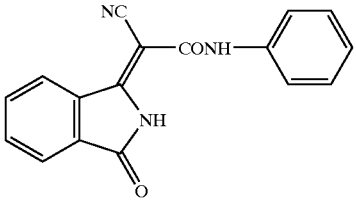
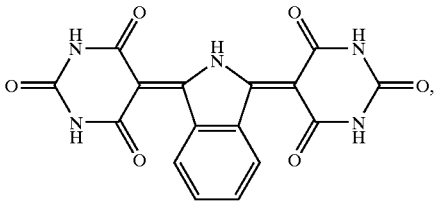
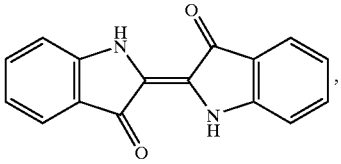
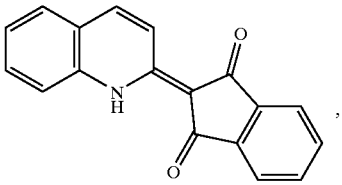
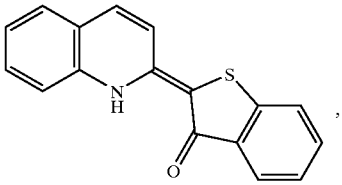

-continued
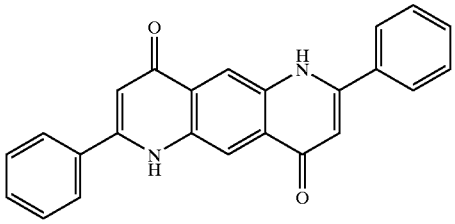
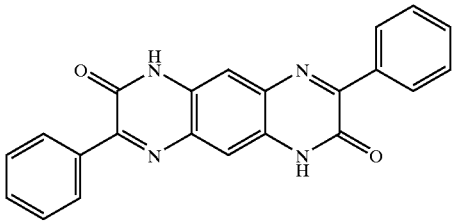
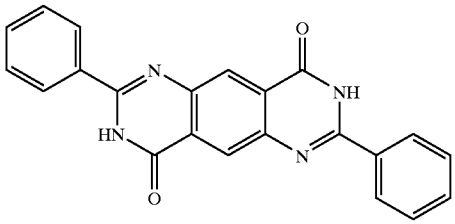
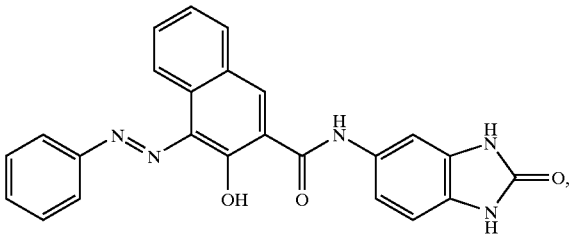
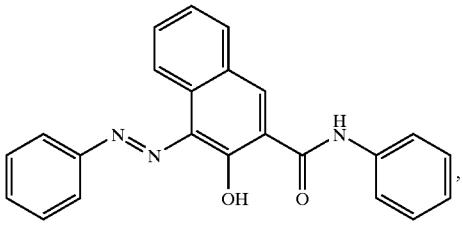
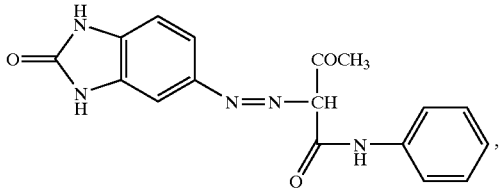
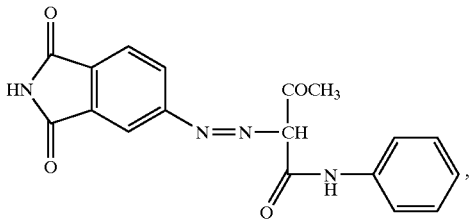
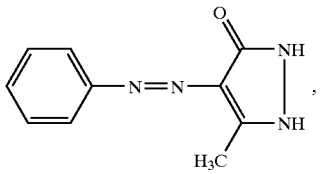
-continued
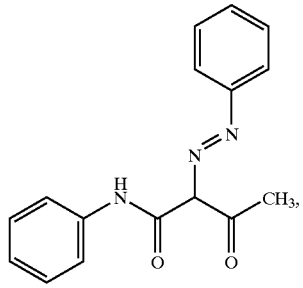
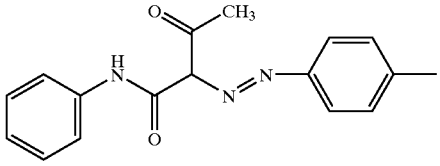
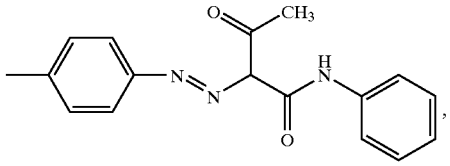
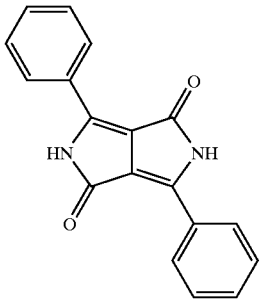
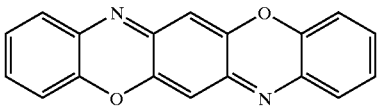
or
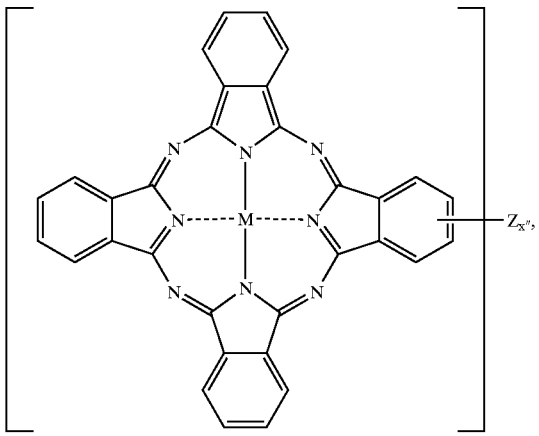
for example,
in which Z, for example, is
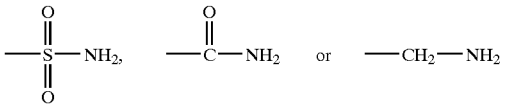

and x" is a number from 1 to 16, in particular from 1 to 4; and in each case all known derivatives thereof.

Mention may be made in particular of those soluble chromophores wherein the pigment of the formula $A(H)_x$ (V) comprises Colour Index Pigment Yellow 13, Pigment Yellow 73, Pigment Yellow 74, Pigment Yellow 83, Pigment Yellow 93, Pigment Yellow 94, Pigment Yellow 95, Pigment Yellow 109, Pigment Yellow 110, Pigment Yellow 120, Pigment Yellow 128, Pigment Yellow 139, Pigment Yellow 151, Pigment Yellow 154, Pigment Yellow 175, Pigment Yellow 180, Pigment Yellow 181, Pigment Yellow 185, Pigment Yellow 194, Pigment Orange 31, Pigment Orange 71, Pigment Orange 73, Pigment Red 122, Pigment Red 144, Pigment Red 166, Pigment Red 184, Pigment Red 185, Pigment Red 202, Pigment Red 214, Pigment Red 220, Pigment Red 221, Pigment Red 222, Pigment Red 242, Pigment Red 248, Pigment Red 254, Pigment Red 255, Pigment Red 262, Pigment Red 264, Pigment Brown 23, Pigment Brown 41, Pigment Brown 42, Pigment Blue 25, Pigment Blue 26, Pigment Blue 60, Pigment Blue 64, Pigment Violet 19, Pigment Violet 29, Pigment Violet 32, Pigment Violet 37, 3,6-di(4'-cyanophenyl)-2,5-dihydropyrrolo[3,4-c]pyrrole-1,4-dione, 3,6-di(3,4-dichloro-phenyl)-2,5-dihydropyrrolo[3,4-c]pyrrole-1,4-dione or 3-phenyl-6-(4'-tert-butylphenyl)-2,5-dihydropyrrolo[3,4-c]pyrrole-1,4-dione.

Further examples are described by Willy Herbst and Klaus Hunger in "Industrial Organic Pigments" (ISBN 3-527-28161-4, VCH/Weinheim 1993).

In general, these soluble pigment precursors have no deprotonatable carboxylic or sulfonic acid groups.

L is preferably a group of the formula

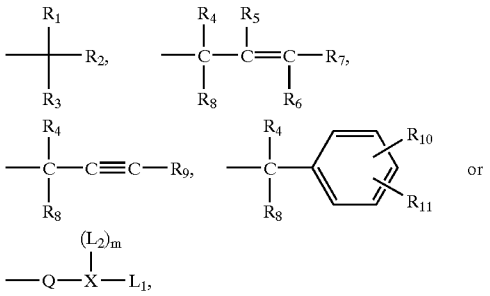

in which $R_1$, $R_2$ and $R_3$ independently of one another are $C_1$–$C_6$alkyl, $R_4$ and $R_8$ independently of one another are $C_1$–$C_6$alkyl, $C_1$–$C_6$alkyl interrupted by O, S or $N(R_{12})_2$, or unsubstituted or $C_1$–$C_6$alkyl-, $C_1$–$C_6$alkoxy-, halogen-, cyano- or nitro-substituted phenyl or biphenylyl, $R_5$, $R_6$ and $R_7$ independently of one another are hydrogen or $C_1$–$C_6$alkyl, $R_9$ is hydrogen, $C_1$–$C_6$alkyl or a group of the formula

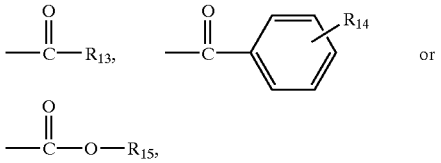

$R_{10}$ and $R_{11}$ independently of one another are hydrogen, $C_1$–$C_6$alkyl, $C_1$–$C_6$alkoxy, halogen, cyano, nitro, $N(R_{12})_2$ or unsubstituted or halogen-, cyano-, nitro-, $C_1$–$C_6$alkyl- or $C_1$–$C_6$alkoxy-substituted phenyl, $R_{12}$ and $R_{13}$ are $C_1$–$C_6$alkyl, $R_{14}$ is hydrogen or $C_1$–$C_6$alkyl and $R_{15}$ is hydrogen, $C_1$–$C_6$alkyl, unsubstituted or $C_1$–$C_6$alkyl-substituted phenyl, Q is p,q-$C_2$–$C_6$alkylene which is unsubstituted or substituted one or more times by $C_1$–$C_6$alkoxy, $C_1$–$C_6$alkythio or $C_2$–$C_{12}$dialkylamino, p and q being different locants, X is a heteroatom selected from the group consisting of N, O and S, m being 0 if x is O or S and 1 if x is N, and $L_1$ and $L_2$ independently of one another are $[\text{-(p',q'-}C_2\text{–}C_6\text{alkylene)-Z-}]_n$—$C_1$–$C_6$alkyl or $C_1$–$C_6$alkyl which is unsubstituted or substituted one or more times by $C_1$–$C_{12}$alkoxy, $C_1$–$C_{12}$alkylthio, $C_2$–$C_{24}$dialkylamino, $C_6$–$C_{12}$aryloxy, $C_6$–$C_{12}$arylthio, $C_7$–$C_{24}$alkylarylamino or $C_{12}$–$C_{24}$diarylamino, n being a number from 1 to 1000, p' and q' being different locants, each Z independently of the others being a heteroatom O, S or $C_1$–$C_{12}$alkyl-substituted N, and $C_2$–$C_6$alkylene in the repeating units [—$C_2$–$C_6$alkylene-Z-] being identical or different, and $L_1$ and $L_2$ may be saturated or unsaturated 1 to 10 times, uninterrupted or interrupted at any desired points by from 1 to 10 groups selected from the group consisting of —(C═O)— and —$C_6H_4$—, and $L_1$ and $L_2$ may carry none or from 1 to 10 further substituents selected from the group consisting of halogen, cyano and nitro.

Of particular interest are compounds of the formula (I), in which L is $C_1$–$C_6$alkyl, $C_2$–$C_6$alkenyl or

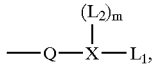

in which Q is $C_2$–$C_4$alkylene, and $L_1$ and $L_2$ are $[—C_2\text{–}C_{12}\text{alkylene-Z-}]_n$—$C_1$–$C_{12}$alkyl or are $C_1$–$C_{12}$alkyl substituted one or more times by $C_1$–$C_{12}$alkoxy, $C_1$–$C_{12}$alkylthio or $C_2$–$C_{24}$dialkylamino, and m and n are as defined above.

Of very particular interest are compounds of the formula (I) in which L is $C_4$–$C_5$alkyl, $C_3$–$C_6$alkenyl or

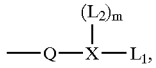

in which Q is $C_2$–$C_4$alkylene, X is O and m is zero, and $L_1$ is $[—C_2\text{–}C_{12}\text{alkylene-O—}]_n$—$C_1$–$C_{12}$alkyl or is $C_1$–$C_{12}$alkyl substituted one or more times by $C_1$–$C_{12}$alkoxy, especially those in which —Q—X— is a group of the formula —$C(CH_3)_2$—$CH_2$—O—.

Alkyl or alkylene may be straight-chain or branched, monocyclic or polycyclic.

$C_1$–$C_{12}$Alkyl is therefore, for example, methyl, ethyl, n-propyl, isopropyl, n-butyl, sec-butyl, isobutyl, tert-butyl, cyclobutyl, n-pentyl, 2-pentyl, 3-pentyl, 2,2-dimethylpropyl, cyclopentyl, cyclohexyl, n-hexyl, n-octyl, 1,1,3,3-tetramethylbutyl, 2-ethylhexyl, nonyl, trimethylcyclohexyl, decyl, menthyl, thujyl, bornyl, 1-adamantyl, 2-adamantyl or dodecyl.

If $C_2$–$C_{12}$alkyl is mono- or polyunsaturated, it is $C_2$–$C_{12}$alkenyl, $C_2$–$C_{12}$alkynyl, $C_2$–$C_{12}$alkapolyenyl or $C_2$–$C_{12}$alkapolyynyl, it being possible for two or more double bonds to be present, if desired, in isolation or conjugation, such as vinyl, allyl, 2-propen-2-yl, 2-buten-1-yl, 3-buten-1-yl, 1,3-butadien-2-yl, 2-cyclobuten-1-yl, 2-penten-1-yl, 3-penten-2-yl, 2-methyl-1-buten-3-yl, 2-methyl-3-buten-2-yl, 3-methyl-2-buten-1-yl, 1,4-pentadien-3-yl, 2-cyclopenten-1-yl, 2-cyclohexen-1-yl, 3-cyclohexen-1-yl, 2,4-cyclohexadien-1-yl, 1-p-menthen-8-yl, 4(10)-thujen-10-yl, 2-norbornen-1-yl, 2,5-norbornadien-1-yl, 7,7-dimethyl-2,4-norcaradien-3-yl or the various isomers of hexenyl, octenyl, nonenyl, decenyl or dodecenyl, for example.

$C_2$–$C_4$Alkylene is, for example, 1,2-ethylene, 1,2-propylene, 1,3-propylene, 1,2-butylene, 1,3-butylene, 2,3-butylene, 1,4-butylene or 2-methyl-1,2-propylene. $C_5$–$C_{12}$Alkylene is, for example, an isomer of pentylene, hexylene, octylene, decylene or dodecylene.

$C_1$–$C_{12}$Alkoxy is O—$C_1$–$C_{12}$alkyl, preferably O—$C_1$–$C_4$alkyl.

$C_6$–$C_{12}$Aryloxy is $C_6$–$C_{12}$aryl, for example phenoxy or naphthoxy, preferably phenoxy.

$C_1$–$C_{12}$Alkylthio is S—$C_1$–$C_{12}$alkyl, preferably S—$C_1$–$C_4$alkyl.

$C_6$–$C_{12}$Arylthio is S—$C_6$–$C_{12}$aryl, for example phenylthio or naphthylthio, preferably phenylthio.

$C_2$–$C_{24}$Dialkylamino is N(alkyl$_1$)(alkyl$_2$), the sum of the carbon atoms in the two groups alkyl$_1$ and alkyl$_2$ being from 2 to 24, preferably N($C_1$–$C_4$alkyl)—$C_1$–$C_4$alkyl.

$C_7$–$C_{24}$Alkylarylamino is N(alkyl$_1$)(aryl$_2$), the sum of the carbon atoms in the two groups alkyl$_1$ and aryl$_2$ being from 7 to 24, for example methylphenylamino, ethylnaphthylamino or butylphenanthrylamino, preferably methylphenylamino or ethylphenylamino.

$C_{12}$–$C_{24}$Diarylamino is N(aryl$_1$)(aryl$_2$), the sum of the carbon atoms in the two groups aryl$_1$ and aryl$_2$ being from 12 to 24, for example diphenylamino or phenylnaphthylamino, preferably diphenylamino.

Halogen is chlorine, bromine, fluorine or iodine, preferably fluorine or chlorine, with particular preference chlorine.

n is preferably a number from 1 to 100, with particular preference a number from 2 to 12.

Examples of suitable compounds of the formula (I) are disclosed in EP-A-0 648 770, EP-A-0 648 817, EP-A-0 742 255, EP-A-0 761 772, WO-98/32802, WO-98/45757, WO-98/58027, WO-99/01511, WO-00/17275, WO-00/39221, PCT/EP-00/03085 and CH-1755/99.

The pigment precursors may be used individually or else in mixtures with other pigment precursors or with colorants, for example dyes customary for the application in question. Where the pigment precursors are used in mixtures, the components of the mixture are preferably components whose colour in the pigmentary form is red, yellow, blue, green, brown or black. From these it is possible to produce brown shades having a particularly natural appearance. Dyes, if added, are likewise preferably red, yellow, blue, green, brown or black.

The methods and conditions for the treatment of wood and wood products are known in the technical literature, which is expressly incorporated herein by reference. For example, the methods and conditions for treatment with solutions are described at length in Ullmann's Encyclopedia of Industrial Chemistry, Vol. A28, 305–393 (5th Edition, 1996) and Kirk-Othmer Encyclopedia of Chemical Technology, Vol. 24, 579–611 (3rd Edition, 1978). The application temperature may be increased, but is judiciously kept sufficiently low that the dissolved or melted pigment precursor undergoes minimal decomposition if any during the minimum time required for the application. If desired, further substances known for the treatment of the material may be added to the solution or melt of the pigment precursor, such as fungicides, antibiotics, flame retardants or moisture repellents, for example.

Suitable solvents include water or, preferably, any desired protic or aprotic solvents, such as hydrocarbons, alcohols, amides, nitriles, nitro compounds, N-heterocycles, ethers, ketones and esters, for example, which if desired may also be mono- or polyunsaturated or -chlorinated, for example methanol, ethanol, isopropanol, diethyl ether, acetone, methyl ethyl ketone, 1,2-dimethoxyethane, 1,2-diethoxyethane, 2-methoxyethanol, ethyl acetate, tetrahydrofuran, dioxane, acetonitrile, benzonitrile, nitrobenzene, N,N-dimethylformamide, N,N-dimethylacetamide, dimethyl sulfoxide, N-methylpyrrolidone, pyridine, picoline, quinoline, trichloroethane, benzene, toluene, xylene, anisole or chlorobenzene. Further examples of solvents are described in numerous tabular and reference books. Instead of a single solvent it is also possible to use mixtures of two or more solvents.

Preference is given to those solvents which have a very slow etching effect, if any, on the substrate to be coloured and have a boiling point of between 40° C. and 170° C., especially aromatic hydrocarbons, alcohols, ethers, ketones and esters. Particular preference is given to toluene, methanol, ethanol, isopropanol, 1,2-dimethoxyethane, 1,2-diethoxyethane, 1-methoxy-2-propanol, acetone, methyl ethyl ketone, ethyl acetate, tetrahydrofuran and dioxane, and to mixtures thereof.

One particularly preferred embodiment is the use of a mixture of from 5 to 25% by weight of water and from 95 to 75% by weight of an alcohol or ketone, especially methanol, ethanol, isopropanol, acetone or ethyl methyl ketone.

The organic $C_1$–$C_6$ carboxylic acid comprises, for example, formic acid, acetic acid, propionic acid, pivalic acid, oxalic acid, malonic acid, succinic acid or citric acid. On account of their high polarity and hydrophilicity, preference is given to carboxylic acids in which the ratio of oxygen to carbon is as high as possible, in particular at least 1.

Salts of the formula (II), (III) or (IV) may also be used as mixtures of two or more components, for example from 2 to 9 salts of the formula (II) and/or (III) and/or (IV). The overall concentration of the salts of the formulae (II), (III) and (IV) is preferably from 0.01 to 2% by weight, with particular preference from 0.05 to 0.10% by weight, based on the solution.

With very particular preference, the overall concentration of the salts of the formula (II), (III), or (IV) is from 1 to 150% by weight of the overall concentration of the compounds of the formula (I), for example from 20 to 50% by weight (II), (III) and (IV) in dark shades, from 50 to 95% by weight (II), (III) and (IV) in medium shades, and from 95 to 125% by weight (II), (III) and (IV) in light shades, based in each case on (I).

The concentration of the pigment precursor in water or a solvent is usually from 0.01% by weight to around 99% of the saturation concentration, it being possible in some cases to use even supersaturated solutions without premature precipitation of the solvate. In the case of many pigment precursors, the optimum concentration is around from 0.05 to 10% by weight, often around from 0.1 to 5% by weight of pigment precursor, based on water or the solvent.

The solution of the compounds of the formula (I) preferably has a pH of from 8 to 10. The coloration a) takes place

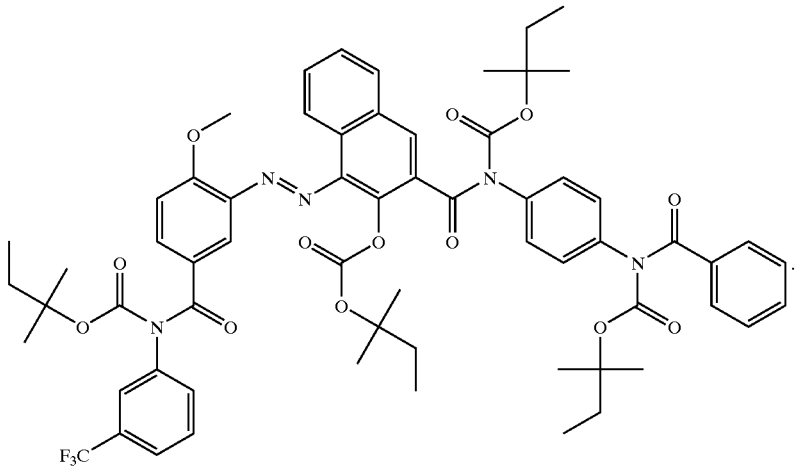

preferably at elevated temperature, for example at from 40 to 160° C. Preferably, the temperature during the coloration is from 60 to 140° C., with particular preference from 80 to 120° C.

The concentration of the organic $C_1$–$C_6$carboxylic acid is preferably from 0.1 to 20% by weight, based on the solution.

The conversion of the pigment precursor to its pigmentary form takes place by fragmentation under known conditions, for example thermally, in the presence or absence of an additional catalyst, for example a cationic photoinitiator, which may be introduced before, simultaneously with or after the pigment precursor into the pores of the porous material. If desired, use is made preferably of the catalysts described in EP-99810107.5.

Fragmentation may be carried out individually, or simultaneously with any subsequent known further treatment, for example during curing of an additional transparent coating film.

Heating may be effected by any desired means, for example by treatment in a thermal oven or by electromagnetic radiation, for example IR or NIR radiation, or microwaves, in the presence or absence of a catalyst. The conditions required for fragmentation are known per se for each class of pigment precursor.

The temperature for converting the soluble pigment precursors to the corresponding pigments is judiciously from 40 to 160° C. It is preferably from 60 to 140° C., with particular preference from 80 to 120° C. The examples which follow illustrate the invention without restricting its scope (unless stated otherwise, "%" is always % by weight):

EXAMPLE 1

In a 1.5 l reaction vessel provided with a stirrer, a thermometer and a nitrogen inlet, 50.0 g of Pigment Red 222 are suspended in 500 ml of o-xylene. At room temperature, 4.4 g of dimethylaminopyridine and 88.7 g of di-t-amyl pyrocarbonate are added. The reaction mixture is stirred at 23° C. for 16 hours. Subsequently, the solution is concentrated to a third of its volume under reduced pressure at 40° C. and then 60 ml of ethanol are added. 600 ml of n-hexane are added dropwise with rapid stirring. The precipitated product is filtered off, washed with hexane and dried at 40° C./20 mbar. This gives 80.7 g (98% of theory) of an outstandingly pure, bright red powder of the structure:

The $^1$H-NMR, TGA and C,N,H,F analytical data are in agreement with the structure. The purity (determined by HPLC) is 99%.

EXAMPLE 2

A piece of obeche wood measuring 50×50×0.6 mm is immersed at 100° C. for 16 hours in a solution of 3.0 g of compound from Example 1 and 0.2 g of $NaHCO_3$ in 92 g of Dowanol® 33-B (1-methoxy-2-propanol) and 5 g of water. After the coloration, the wood is removed, predried in air for 45 minutes and then dried at 80° C./150 mbar for 15 minutes. It is then immersed for 2 hours in a solution of 5 g of citric acid in 95 ml of water and subsequently dried at 140° C. for 30 minutes. Visual inspection on a transverse cut shows homogeneous coloration right through.

EXAMPLE 3

The procedure of Example 2 is repeated but using 0.1 g of sodium acetate, 87 g of Dowanol® 33-B and 10 g of water. The results are the same as those of Example 2.

EXAMPLE 4

A piece of bleached obeche wood measuring 110×32×0.8 mm is immersed at 110° C. for 6 hours in a solution of 0.08 g of the compound from Example 1 and 0.1 g of $NaHCO_3$ in 85 g of Dowanol® 33-B and 15 g of water. The closed vessel is rotated. Following the coloration, the wood is removed and treated further as in Example 2. Visual inspection on a transverse cut shows homogeneous coloration right through.

EXAMPLE 5

The procedure of Example 4 is repeated but using $Na_2CO_3$ instead of $NaHCO_3$. The results are comparable with those of Example 4.

EXAMPLES 6–14

The procedure of Example 4 is repeated but replacing 0.1 g of $NaHCO_3$ by 0.15 g of each of the following salts:

| | | |
|---|---|---|
| $KHCO_3$ | $Na_2HPO_4$ | tri-potassium citrate |
| $K_2CO_3$ | $K_2HPO_4$ | sodium formate |
| $(NH_4)_2CO_3$ | tri-sodium citrate | potassium formate |

The results are in all cases good and comparable with those of Example 4, especially as regards colouring right through.

EXAMPLE 15

The procedure of Example 4 is repeated but using 0.25 g of $CaCO_3$ instead of 0.1 g of $NaHCO_3$.

EXAMPLES 16–27

The procedure of Examples 4–15 is repeated but replacing the compound from Example 1 by the compound from Example A4 of WO-00/36210 or Example 5 of WO-00/39221. The results are analogous to those of Examples 4–15.

EXAMPLES 28–39

The procedure of Examples 4–15 is repeated but replacing the compound from Example 1 by the compound from Example A2 of WO-00/36210 (STN Registry Number 214289-84-6). The results are analogous to those of Examples 4–15.

EXAMPLES 40–51

The procedure of Examples 28–39 is repeated but replacing the compound from Example 1 by the compound from Example A8 of WO-00/36210. The results are analogous to those of Examples 28–39.

EXAMPLES 52–63

The procedure of Examples 4–15 is repeated but replacing the compound from Example 1 by the compound of the following structure (obtainable in accordance with methods known per se from C.I. Pigment Violet 32):

The results are analogous to those of Examples 4–15.

EXAMPLES 64–75

The procedure of Examples 4–15 is repeated but replacing the compound from Example 1 by the compound from Example 15 of WO-98/32802. The results are analogous to those of Examples 4–15.

EXAMPLES 76–87

The procedure of Examples 4–15 is repeated but replacing the compound from Example 1 by the compound from Example 11 of PCT/EP-00/03085. The results are analogous to those of Examples 4–15.

EXAMPLES 88–99

The procedure of Examples 4–15 is repeated but replacing the compound from Example 1 by the compound of the following structure (obtainable in accordance with the method known from U.S. Pat. No. 6,063,924 from C.I. Pigment Red 222):

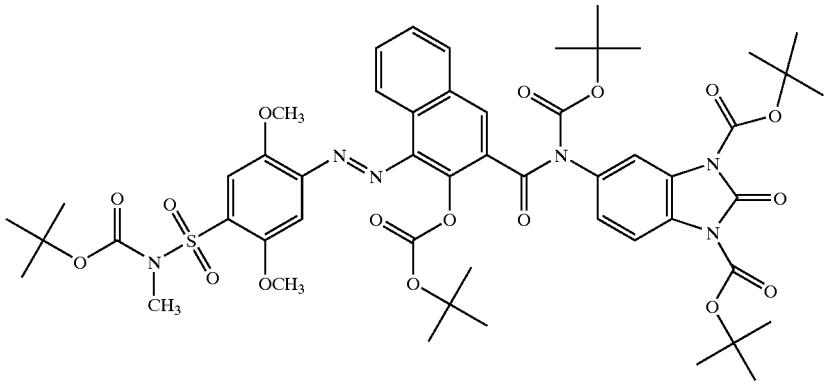

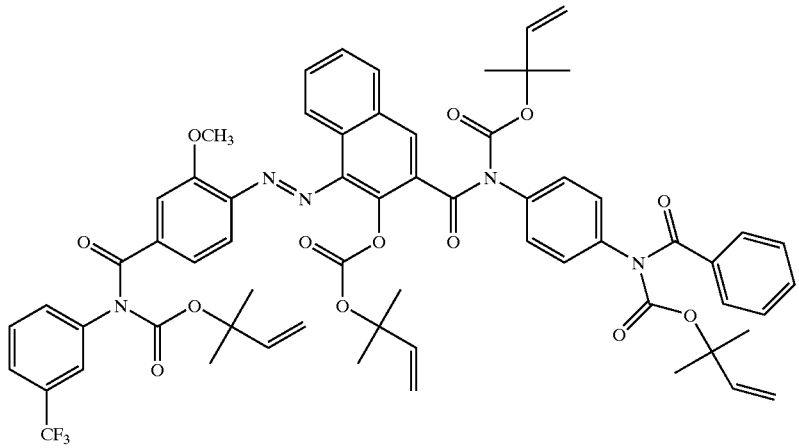

The results are analogous to those of Examples 4–15.

EXAMPLES 100–111

The procedure of Examples 4–15 is repeated but replacing the compound from Example 1 by the compound from Example B1 of EP-A-1 044 945. The results are analogous to those of Examples 4–15.

EXAMPLES 112–123

The procedure of Examples 4–15 is repeated but replacing the compound from Example 1 by the compound from Example A4 of WO-00/36210 (STN Registry Number 214289-82-4). The results are analogous to those of Examples 4–15.

EXAMPLES 124–243

The procedure of Examples 4–123 is repeated but using 3 g each of soluble pigment precursor and compound of the formula (II), (III) or (IV).

EXAMPLES 244–263

The procedure of Examples 4–123 is repeated but using the soluble pigment precursor in saturated concentration and using in each case 1 g of the compound of the formula (II), (III) or (IV).

What is claimed is:

1. A process for pigmenting wood, which comprises treating wood in succession:

a) with a solution comprising from 0.01 to 80% by weight, based on the solution, of a compound of the formula $$A(B)_x \qquad (I),$$

in which x is an integer from 1 to 8,

A is the radical of a chromophore of the quinacridone, anthraquinone, perylene, indigo, quinophthalone, indanthrone, isoindolinone, isoindoline, dioxazine, azo, phthalocyanine or diketopyrrolopyrrole series which is attached to x groups B via one or more heteroatoms, these heteroatoms being selected from the group consisting of N, O and S and forming part of the radical A, B is hydrogen or a group of the formula

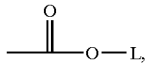

at least one group B not being hydrogen and, if x is a number from 2 to 8, the groups B being identical or different, and L is a group of the formula

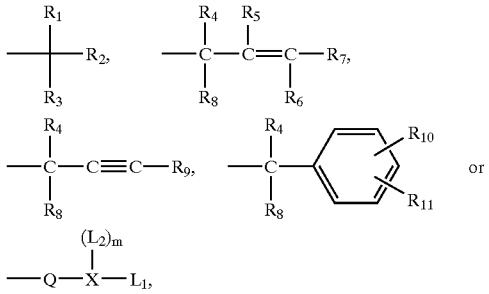

in which $R_1$, $R_2$ and $R_3$ independently of one another are $C_1$–$C_6$alkyl, $R_4$ and $R_8$ independently of one another are $C_1$–$C_6$alkyl, $C_1$–$C_6$alkyl interrupted by O, S or $N(R_{12})_2$, or unsubstituted or $C_1$–$C_6$alkyl-, $C_1$–$C_6$alkoxy-, halogen-, cyano- or nitro-substituted phenyl or biphenyl, $R_5$, $R_6$ and $R_7$ independently of one another are hydrogen or $C_1$–$C_6$alkyl, $R_9$ is hydrogen, $C_1$–$C_6$alkyl or a group of the formula

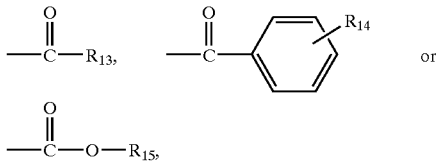

$R_{10}$ and $R_{11}$ independently of one another are hydrogen, $C_1$–$C_6$alkyl, $C_1$–$C_6$alkoxy, halogen, cyano, nitro, $N(R_{12})_2$ or unsubstituted or halogen-, cyano-, nitro-, $C_1$–$C_6$alkyl- or $C_1$–$C_6$alkoxy-substituted phenyl, $R_{12}$ and $R_{13}$ are $C_1$–$C_6$alkyl, $R_{14}$ is hydrogen or $C_1$–$C_6$alkyl and $R_{16}$ is hydrogen, $C_1$–$C_6$alkyl, unsubstituted or $C_1$–$C_6$alkyl-substituted phenyl, Q is p,q-$C_2$–$C_6$alkylene which is unsubstituted or substituted one or more times by $C_1$–$C_6$alkoxy, $C_1$–$C_6$alkythio or $C_2$–$C_{12}$dialkylamino, p and q being different locants, X is a heteroatom selected from the group consisting of N, O and S, m being 0 if x is O or S and 1 if x is N, and $L_1$ and $L_2$ independently of one another are [-(p',q'-$C_2$–$C_6$alkylene)-Z-]$_n$—$C_1$–$C_6$alkyl or $C_1$–$C_6$alkyl which is unsubstituted or substituted one or more times by $C_1$–$C_{12}$alkoxy, $C_1$–$C_{12}$alkylthio, $C_1$–$C_{24}$dialkylamino, $C_6$–$C_{12}$aryloxy, $C_6$–$C_{12}$arylthio, $C_7$–$C_{24}$alkylarylamino or $C_{12}$–$C_{24}$diarylamino, n being a number from 1 to 1000, p' and q' being different locants, each Z independenty of the others being a heteroatom O, S or $C_1$–$C_{12}$alkyl-substituted N, and $C_2$–$C_6$alkylene in the repeating units [—$C_2$–$C_6$alkylene-Z-] being identical or different, and $L_1$ and $L_2$ may be saturated or unsaturated 1 to 10 times, uninterrupted or interrupted at any desired points by from 1 to 10 groups selected from the group consisting of —(C=O)— and —$C_6H_4$—, and $L_1$ and $L_2$ may carry none or from 1 to 10 further substituents selected from the group consisting of halogen, cyano and nitro; and from 0.05 to 5% by weight, based on the solution, of a salt of the formula $$Kat^+.An^- \quad (II),$$

$$Kat^+.\tfrac{1}{2}An^{2-} \quad (III)$$

or $$Kat^+.\tfrac{1}{3}An^{3-} \quad (IV),$$

in which $Kat^+$ is lithium, sodium, potassium or ammonium, $An^-$ is formate, acetate, propionate or hydrogen carbonate, $An^{2-}$ is oxalate, maleate, fumarate, malonate, carbonate or hydrogen phosphate, and $An^{3-}$ is citrate or phosphate, in water or an organic solvent or in a single-phase mixture thereof, b) with a solution comprising from 0.01 to 50% by weight, based on the solution, of an organic $C_1$–$C_6$carboxylic acid in water or an organic solvent or in a single-phase mixture thereof, and c) converting the compound of the formula (I) thermally to a pigment of the formula.

2. A process according to claim 1, wherein the pigment of the formula $A(H)_x$ (V) comprises Colour Index Pigment Yellow 13, Pigment Yellow 73, Pigment Yellow 74, Pigment Yellow 83, Pigment Yellow 93, Pigment Yellow 94, Pigment Yellow 95, Pigment Yellow 109, Pigment Yellow 110, Pigment Yellow 120, Pigment Yellow 128, Pigment Yellow 139, Pigment Yellow 151, Pigment Yellow 154, Pigment Yellow 175, Pigment Yellow 180, Pigment Yellow 181, Pigment Yellow 185, Pigment Yellow 194, Pigment Orange 31, Pigment Orange 71, Pigment Orange 73, Pigment Red 122, Pigment Red 144, Pigment Red 166, Pigment Red 184, Pigment Red 185, Pigment Red 202, Pigment Red 214, Pigment Red 220, Pigment Red 221, Pigment Red 222, Pigment Red 242, Pigment Red 248, Pigment Red 254, Pigment Red 255, Pigment Red 262, Pigment Red 264, Pigment Brown 23, Pigment Brown 41, Pigment Brown 42, Pigment Blue 25, Pigment Blue 26, Pigment Blue 60, Pigment Blue 64, Pigment Violet 19, Pigment Violet 29, Pigment Violet 32, Pigment Violet 37, 3,6-di(4'-cyanophenyl)-2,5-dihydropyrrolo[3,4-c]pyrrole-1,4-dione, 3,6-di(3,4-dichlorophenyl)-2,5-dihydro-pyrrolo[3,4-c]pyrrole-1,4-dione or 3-phenyl-6-(4'-tert-butylphenyl)-2,5-dihydropyrrolo-[3,4-c]pyrrole-1,4-dione.

3. A process according to claim 1, wherein the carboxylic acid comprises formic acid, acetic acid, propionic acid, pivalic acid, oxalic acid, malonic acid, succinic acid or citric acid.

4. A process according to claim 1, wherein the overall concentration of the salts of the formula (II), (III) or (IV) is from 1 to 150% by weight of the overall concentration of the compounds of the formula (I).

5. A process according to claim 1, wherein the single-phase mixture consists of from 5 to 25% by weight of water and from 95 to 75% by weight of an alcohol or ketone and the overall concentration of the salts of the formulae (II), (III) and (IV) is from 0.01 to 2% by weight.

6. A process according to claim 1, wherein the temperature for the thermal conversion is from 40 to 160° C.

7. A process according to claim 1, wherein the overall concentration of the salts of the formulae (II), (III) and (IV) is from 0.05 to 0.10% by weight, based on the solution.

8. A process according to claim 1, wherein the temperature for the thermal conversion is from 80 to 120° C.

* * * * *